US007468496B2

(12) United States Patent
Marchand

(10) Patent No.: US 7,468,496 B2
(45) Date of Patent: Dec. 23, 2008

(54) DYNAMIC FLOW OVEN CAVITY VENT

(75) Inventor: Joseph Marc Pierre Marchand, Terrebonne (CA)

(73) Assignee: Electrolux Home Products, Inc., Cleveland, OH (US)

( * ) Notice: Subject to any disclaimer, the term of this patent is extended or adjusted under 35 U.S.C. 154(b) by 5 days.

(21) Appl. No.: 11/559,951

(22) Filed: Nov. 15, 2006

(65) Prior Publication Data

US 2008/0110879 A1 May 15, 2008

(51) Int. Cl.
*F24C 15/20* (2006.01)

(52) U.S. Cl. ..... 219/400; 219/391; 99/472; 126/21 R; 126/21 A

(58) Field of Classification Search ..... None
See application file for complete search history.

(56) References Cited

U.S. PATENT DOCUMENTS 3,659,579 A 5/1972 Henderson et al.
4,331,124 A 5/1982 Seidel et al.
4,654,508 A 3/1987 Logel et al.
4,971,023 A 11/1990 Martinez
5,140,120 A 8/1992 Kasai et al.
5,918,589 A 7/1999 Valle et al.

FOREIGN PATENT DOCUMENTS

DE 3516847 A * 11/1986
FR 2673268 A1 * 8/1992

* cited by examiner

*Primary Examiner*—Joseph M Pelham
(74) *Attorney, Agent, or Firm*—Pearne & Gordon LLP

(57) ABSTRACT

A cooking appliance includes a main cavity and a ventilation system. A cavity vent extends between the cooking appliance and the ventilation system such that the ventilation system is in fluid communication with the main cavity to expel an exhaust of gases. A chimney is connected above the cavity vent and includes venturi zone therein, wherein the cavity vent is coupled to the chimney at the venturi zone.

17 Claims, 7 Drawing Sheets

DYNAMIC FLOW OVEN CAVITY VENT

BACKGROUND OF THE INVENTION

1. Field of the Invention

The present invention relates generally to an oven and more particularly to an oven ventilation system that reduces the condensation produced.

2. Description of the Related Art

Known oven designs include single ovens, double ovens, and combination ovens that have a conventional oven and a microwave oven. The ovens can be used for roasting food items, including turkeys, chickens, or other high moisture foods. The hot, moist air generated during the roasting of such foods must be dissipated by some sort of ventilation system. Ventilation systems are provided in most ovens for venting some hot air from the oven and to remove moisture when cooking such a high moisture load. However, it is unacceptable to have a large amount of the moisture vented out of the oven because of condensation that could occur on the front of the oven or on the cabinetry surrounding the oven.

Additionally, most ovens include a broiler. Broilers are typically used for cooking such items as steaks and other meats at high temperatures. However, when cooking a steak or the like in the broiler, a large amount of smoke can develop because of the fat in the steak and the high temperatures at which the meat is being cooked. It is obviously undesirable for the ventilation or exhaust system of the oven to pump smoke out of the oven and into the kitchen. Thus, a ventilation system for an oven needs to meet certain design and performance requirements.

There are two important items in the evacuation of air from an oven. One is the volumetric exit velocity of the air from the oven cavity. If the air is evacuated too quickly from the oven cavity, this can negatively affect the cooking performance and oven preheat time. If the evacuation of the air is too slow, the after the completion of a closed door broil, when the user opens the door of the oven, a large smoke cloud could pour forth from the oven and enter the kitchen. Thus, a ventilation system must be designed to handle the dissipation of the smoke cloud to prevent the kitchen from being polluted with smoky air.

The second item in the design of the oven ventilation system is the exhaust air temperature. If the temperature of the exhaust air is too hot then there is a potential of burning the user or damaging kitchen cabinets that surround the oven. Also, an exhaust temperature that is too high may have a negative impact of the efficiency of the oven. For instance, this condition would draw off too much heat that should be used for cooking. Also if the exhaust air temperature is too low, then there is a condensation of the cooking by-products and steam as the exhaust exits the oven. This situation can cause damage to the surrounding cabinets and possibly violate various safety requirements.

BRIEF SUMMARY OF THE INVENTION

The following presents a simplified summary of the invention in order to provide a basic understanding of some aspects of the invention. This summary is not an extensive overview of the invention. It is intended to identify neither key nor critical elements of the invention nor delineate the scope of the invention. Its sole purpose is to present some concepts of the invention in a simplified form as a prelude to the more detailed description that is presented later.

In accordance with one aspect of the present invention, a cooking appliance having a ventilation system is provided.

The cooking appliance includes a main cavity. A cavity vent extends between the cooking appliance and the ventilation system such that the ventilation system is in fluid communication with the main cavity to expel an exhaust of gases. A chimney is connected above the cavity vent and includes venturi zone therein, wherein the cavity vent is coupled to the chimney at the venturi zone.

In accordance with another aspect of the present invention, a cooking appliance having a ventilation system is provided. The cooking appliance includes a main cavity. A cavity vent assembly is included as is in fluid communication with the main cavity to expel an exhaust of gases from the main cavity. A single passage is connected above the cavity vent assembly and includes a chimney, which includes an entry section, a narrowed middle cross-section to create a venturi effect, and an exit section. The cavity vent assembly is coupled to the chimney at the narrowed middle cross-section.

In accordance with yet another aspect of the present invention, a method for reducing condensation in a ventilation system of a cooking appliance is provided. The method includes: expelling exhaust gases from a main cavity of the cooking appliance through a cavity vent and into a chimney; and providing a cooling airflow from a cooling fan into the chimney such that the cooling airflow mixes with the expelled exhaust gases. The cooling airflow mixes with the expelled exhaust gases in a venturi zone of the chimney. The venturi zone has a cross sectional area that is smaller than both an entry section and an exit section of the chimney.

The following description and the annexed drawings set forth in detail contain certain illustrative aspects of the invention. These aspects are indicative, however, of but a few of the various ways in which the principles of the invention may be employed and the present invention is intended to include all such aspects and their equivalents. Other objects, advantages and novel features of the invention will become apparent from the following detailed description of the invention when considered in conjunction with the drawings.

BRIEF DESCRIPTION OF THE DRAWINGS

The foregoing and other features and advantages of the present invention will become apparent to those skilled in the art to which the present invention relates upon reading the following description with reference to the accompanying drawings.

DESCRIPTION OF EXAMPLE EMBODIMENTS

Figure 1:
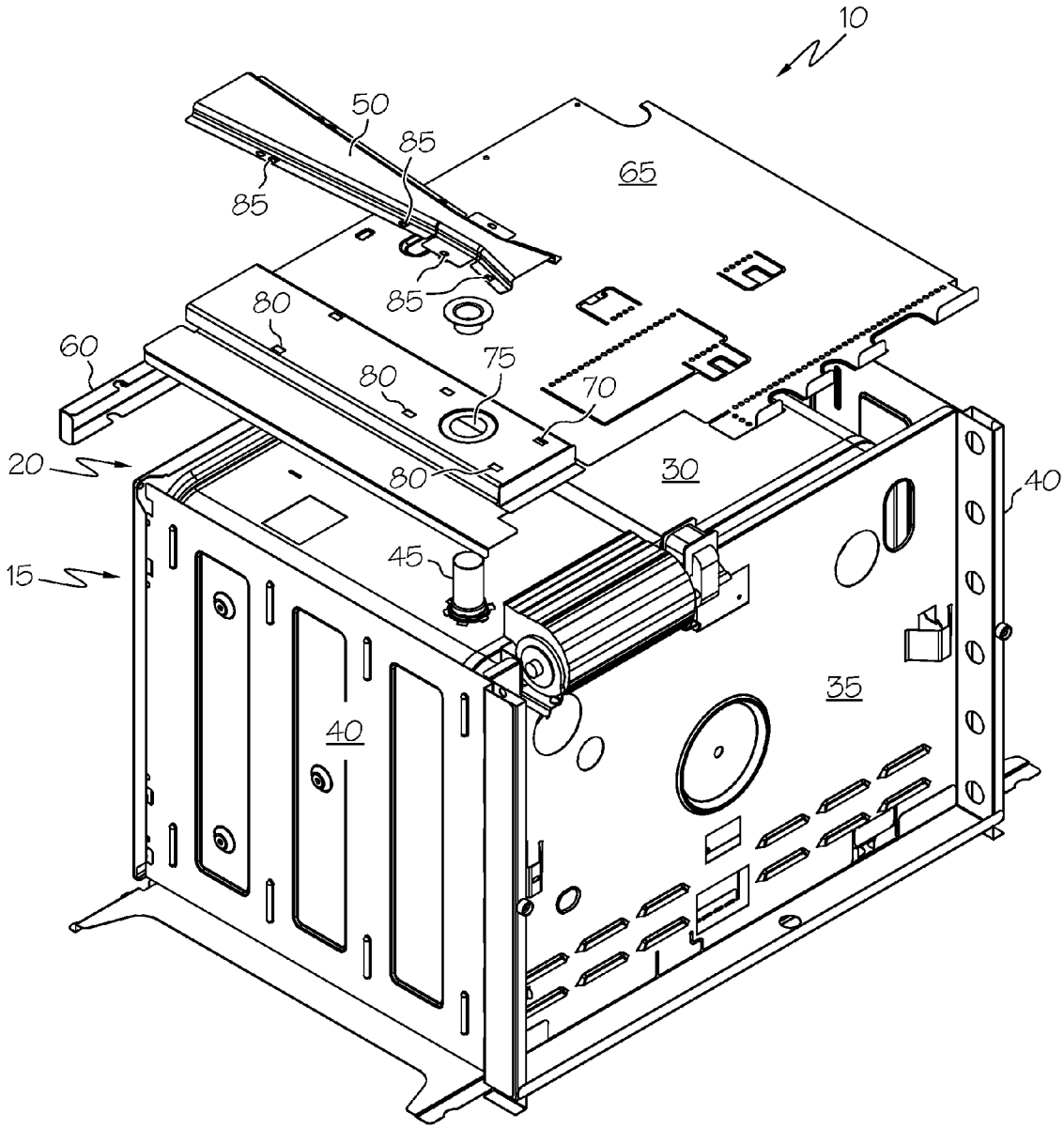
FIG. 1 illustrates an exploded view of a ventilation system for a cooking appliance in accordance with an aspect of the present invention.

The present invention relates to a ventilation system for an oven. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present invention. It may be evident, however, that the present invention can be practiced without these specific details. Additionally, other embodiments of the invention are possible and the invention is capable of being practiced and carried out in ways other than as described. The terminology and phraseology used in describing the invention is employed for the purpose of promoting an understanding of the invention and should not be taken as limiting.

Referring initially to FIG. 1, an exploded view of a ventilation system 10 for a cooking appliance, such as an oven 15, is illustrated in accordance with an aspect of the present invention. The ventilation system 10 is adapted to facilitate expulsion of air and gases from the oven 15. The oven 15 includes a main cavity or cooking area 20 in which items to be baked, broiled, or otherwise cooked are placed. The oven cavity 20 is formed by a bottom wall 25 (FIG. 5), a top wall 30, a back wall 35, and two side walls 40. An oven door (not shown) closes the oven cavity 20. A cavity vent 45 extends from the oven cavity 20 through the top wall 30 and into the ventilation system 10 and is configured to exhaust gases from the interior of the oven cavity 20. The gases are exhausted into the ventilation system 10, which comprises a chimney 50 positioned between a cooling fan 55 (FIG. 2) and a vented front oven panel 60. A plate member 65 is coupled to the top wall 30 of the oven cavity 20 and includes a tunnel portion 70 that can be attached to or integrally formed with the plate member 65. The tunnel portion 70 includes an aperture 75 through which the cavity vent 45 extends. A top surface of the tunnel portion 70 is substantially flat such that the chimney 50 can be coupled there to. More specifically, the top surface of the tunnel portion 70 can include a plurality of apertures 80 that correspond to a plurality of aperture 85 formed in a flange portion 90 of the chimney 50. Thus the chimney 50 can be attached to the tunnel portion 70 via bolts or any other suitable fastener. It is to be appreciated that the chimney 50 can alternatively or additionally be coupled to the tunnel portion 70 in any other suitable manner, such as via a snap fit.

Figure 2:
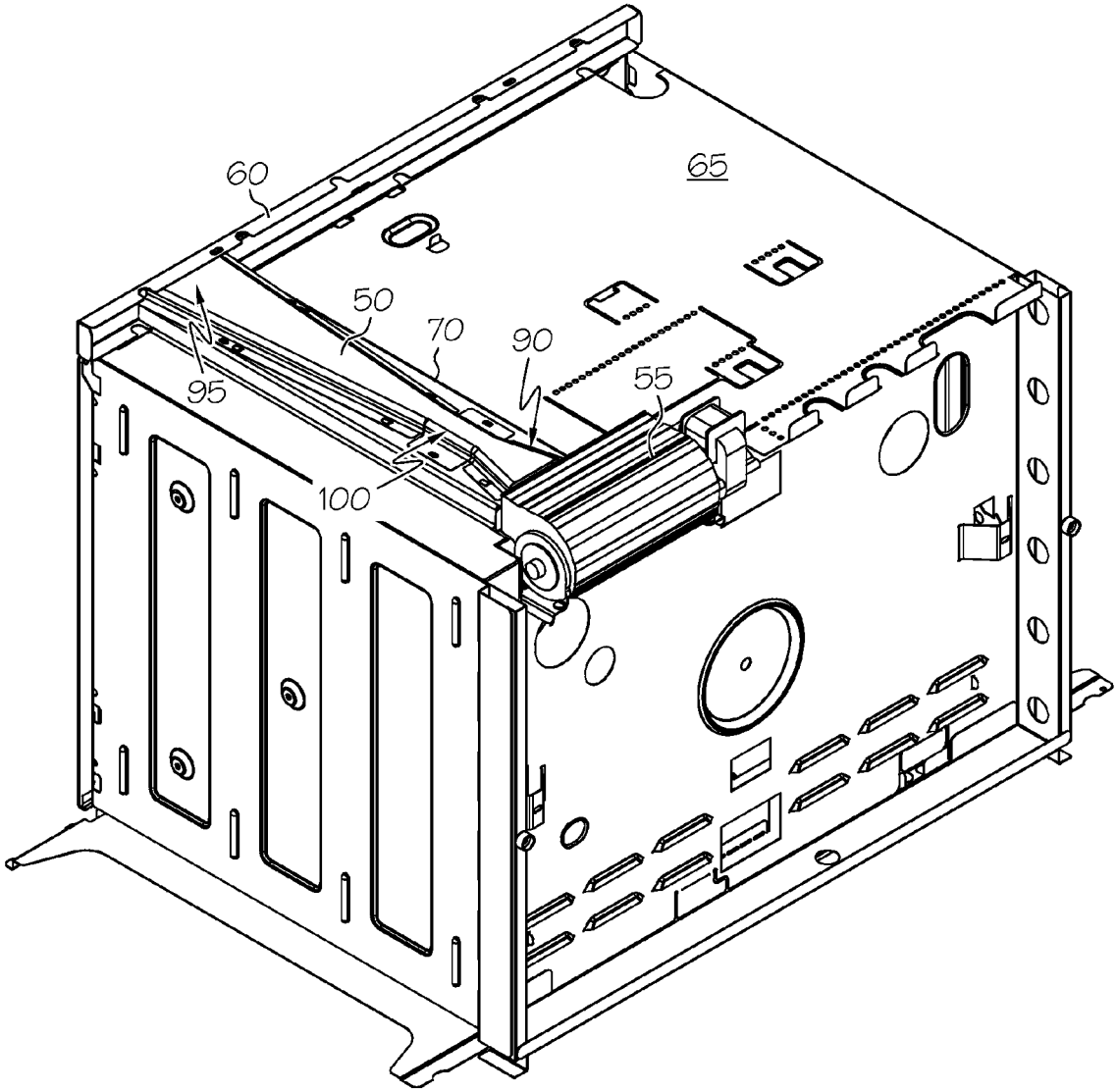
FIG. 2 illustrates an assembled view of the ventilation system of FIG. 1 in accordance with an aspect of the present invention.

FIG. 2 illustrates an assembled view of the ventilation system 10 in accordance with an aspect of the present invention. As shown, the chimney 50 includes an entry section 90, which is in fluid communication with the cooling fan 55, and an exit section 95, which is in fluid communication with the vented front oven panel 60. Accordingly, cooling air is directed into the chimney 50 from the fan 55 to mix with the exhaust gases drawn from the oven cavity via the cavity vent 45. The mixture of cooling air and exhaust gases are then moved out of the chimney 50 through the vented front oven panel 60. The portion of the chimney 50 that is near the cavity vent 45 is narrowed with respect to the entry and exit sections 90, 95 to form a restricted throat portion, or a venturi zone 100. In other words, the throat portion or venturi zone 100 is narrower than the entry section 90 of the chimney 50 receiving air from the cooling fan 55. The throat portion or venturi zone 100 is also narrower than the exit section 95 of the chimney 50, which in turn can also be wider than the entry section 90 of the chimney 50. The relatively narrow cross section of the chimney 50 in the venturi zone 100 is configured to create a slight negative pressure within the chimney 50. This pressure differential ensures a constant draw of moisture and smoke from the cooling fan 55. The venturi cross section 24 augments air velocity and proportionally reduces the local static pressure.

Figure 3:
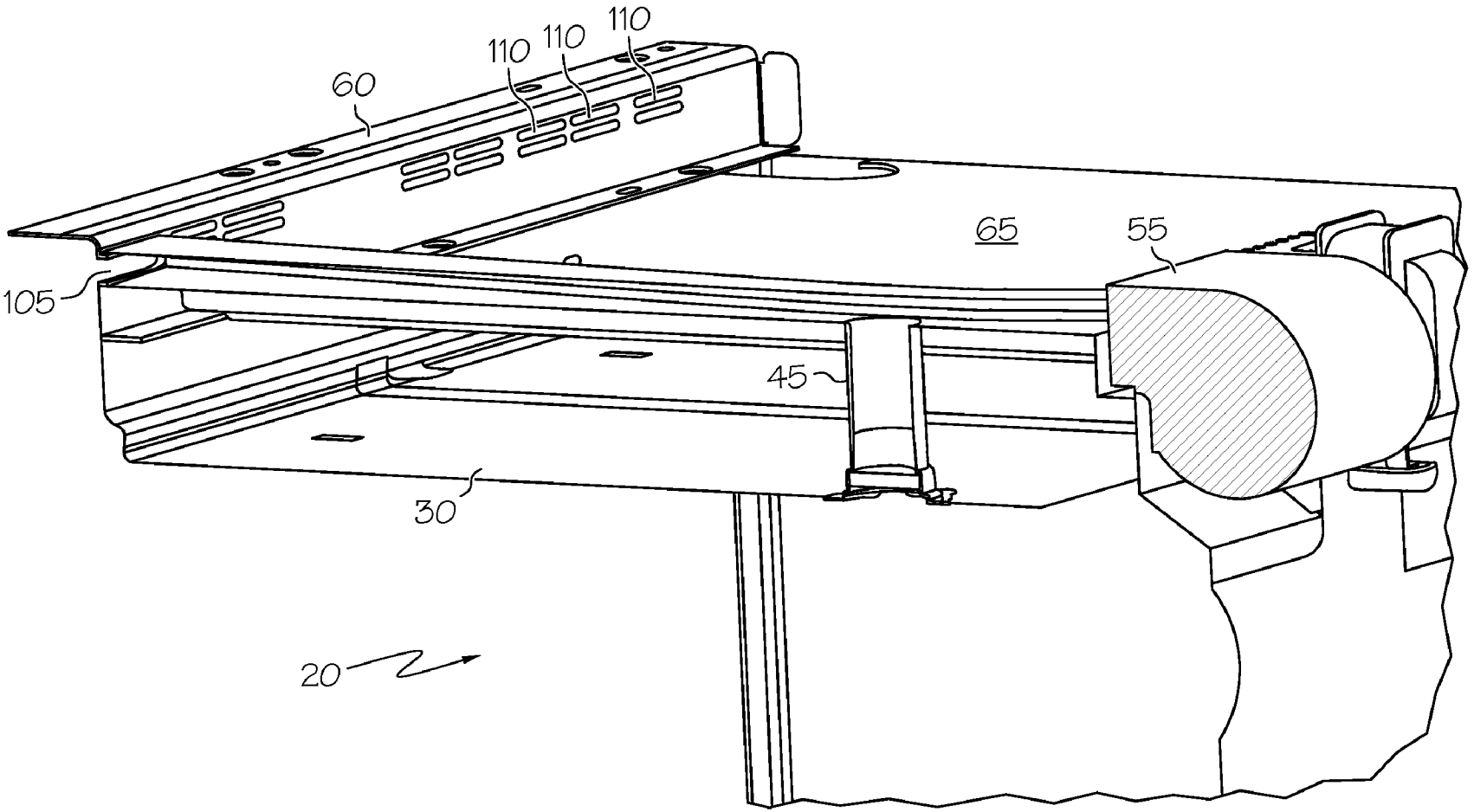
FIG. 3 illustrates a cross sectional view of the ventilation system of FIG. 1 in accordance with an aspect of the present invention.

Turning now to FIG. 3, a cross sectional view of the ventilation system 10 as assembled to the cooking appliance is shown in accordance with an aspect of the present invention. The cross sectional view is taken substantially down a longitudinal center line of the chimney 50. As illustrated, the cavity vent 45 extends into the chimney 50 such that the cavity vent 45 is in fluid communication with the chimney 50. Preferably, there is a gap between a top of the cavity vent 45 and a top surface of the chimney 50 such that air can flow out from the top of the cavity vent 45 into the chimney 50. A catalyst may be provided within the cavity vent 45 to reduce smoke and odor produced within the oven cavity 20. Although it is not clear from the illustration, the cavity vent 45 is positioned within the venturi zone 100 of the chimney 50. The chimney is in fluid communication with the ambient air outside of the cooking appliance via one or more vents 105 provided through the front panel 60. Other vents 110 in the front panel 60 that are not in direct fluid communication with the chimney 50 are provided to vent cooling air, which flows from the fan 55 over the plate member 65.

Figure 4:
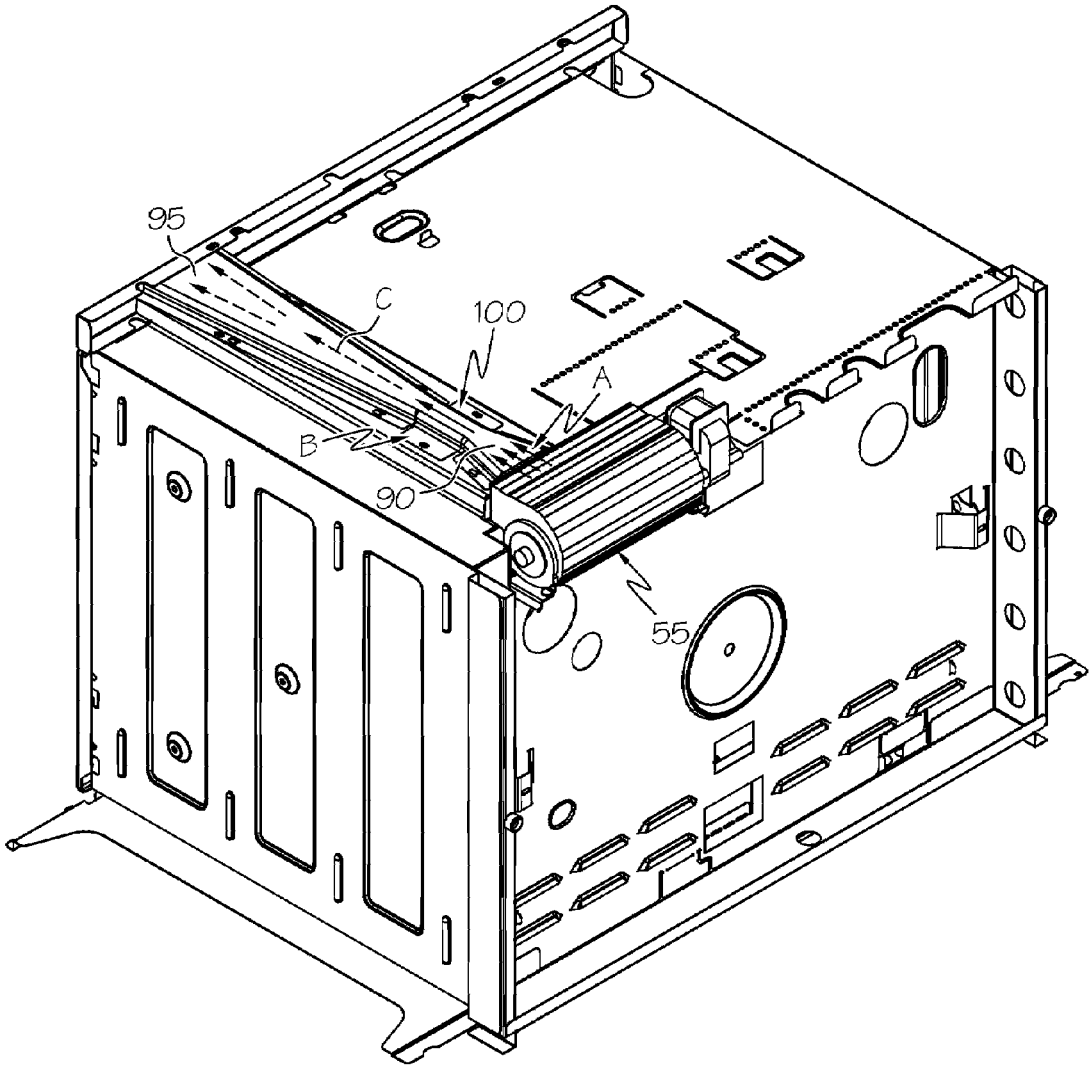
FIG. 4 illustrates an example of an airflow pattern through a ventilation system for a cooking appliance in accordance with an aspect of the present invention.

FIG. 4 illustrates an example of the airflow through the ventilation system 10 in accordance with an aspect of the present invention. The cooling fan 55 expels air A into an entry section 70 of the chimney 50. Air A is cool and is moving at a relatively high velocity, which is created by the fan. The chimney 50 also receives air B from the oven cavity vent 45 at the narrow middle venturi zone 100. Air B draws exhaust gases that are high in moisture and smoke, from the main cavity 20 of the oven. Air B mixes with Air A to form Air C, the mixed air, in the venturi zone 100 of the chimney 50. Air A dilutes the smoke and reduces the relative humidity of Air B. Air C, thus, has a lower moisture and smoke content than Air B, which enters from the oven cavity 20 via the cavity vent 45. Air C exits the chimney 50 through an exit section 95 of the chimney 50 into one or more vents 105 without condensing. Preferably, the chimney is constructed of a single passage for efficient expulsion of gases, maximum elimination of condensation, and for simplicity of design. However, it is to be appreciated that the chimney can be constructed from multiple chimney sections to form a channel as described herein and is still contemplated as falling within the scope of the present invention. Optional thermal insulation (not shown) can be added on top and/or side portions of the oven top to further inhibit condensation formation.

Figure 5:
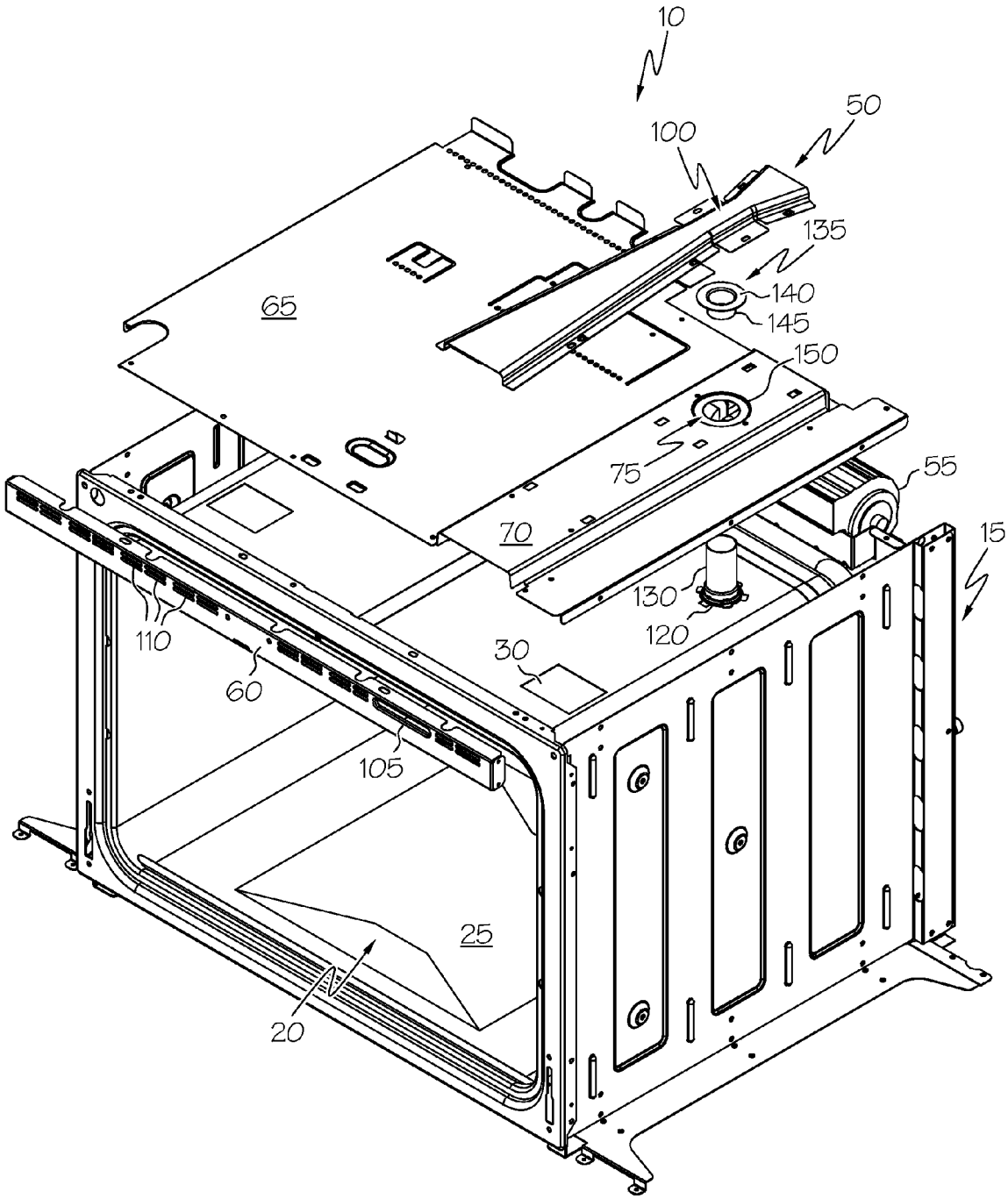
FIG. 5 illustrates an exploded view of another ventilation system for a cooking appliance in accordance with an aspect of the present invention.
Figure 6:
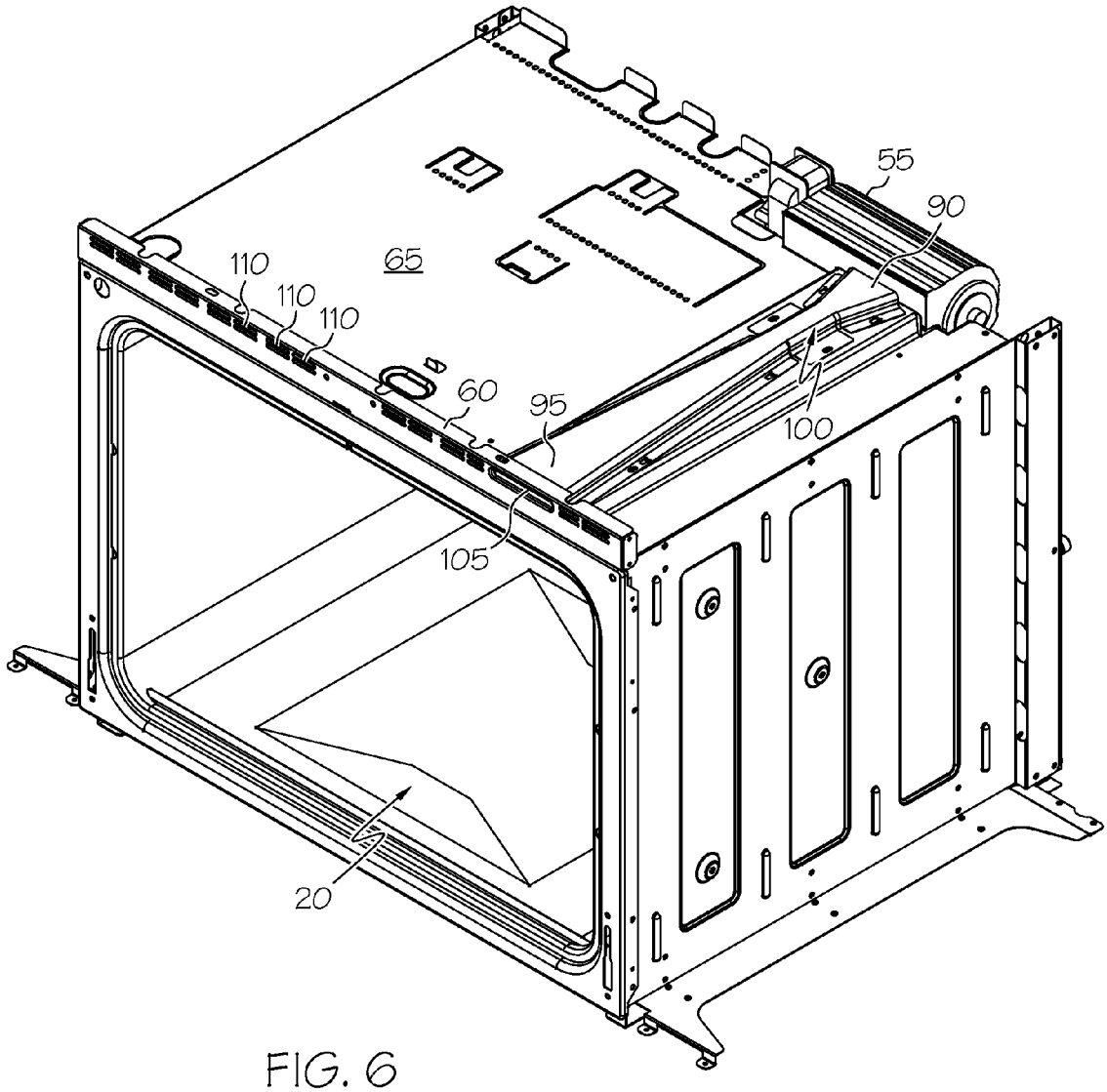
FIG. 6 illustrates an assembled view of the ventilation system of FIG. 5 in accordance with an aspect of the present invention.
Figure 7:
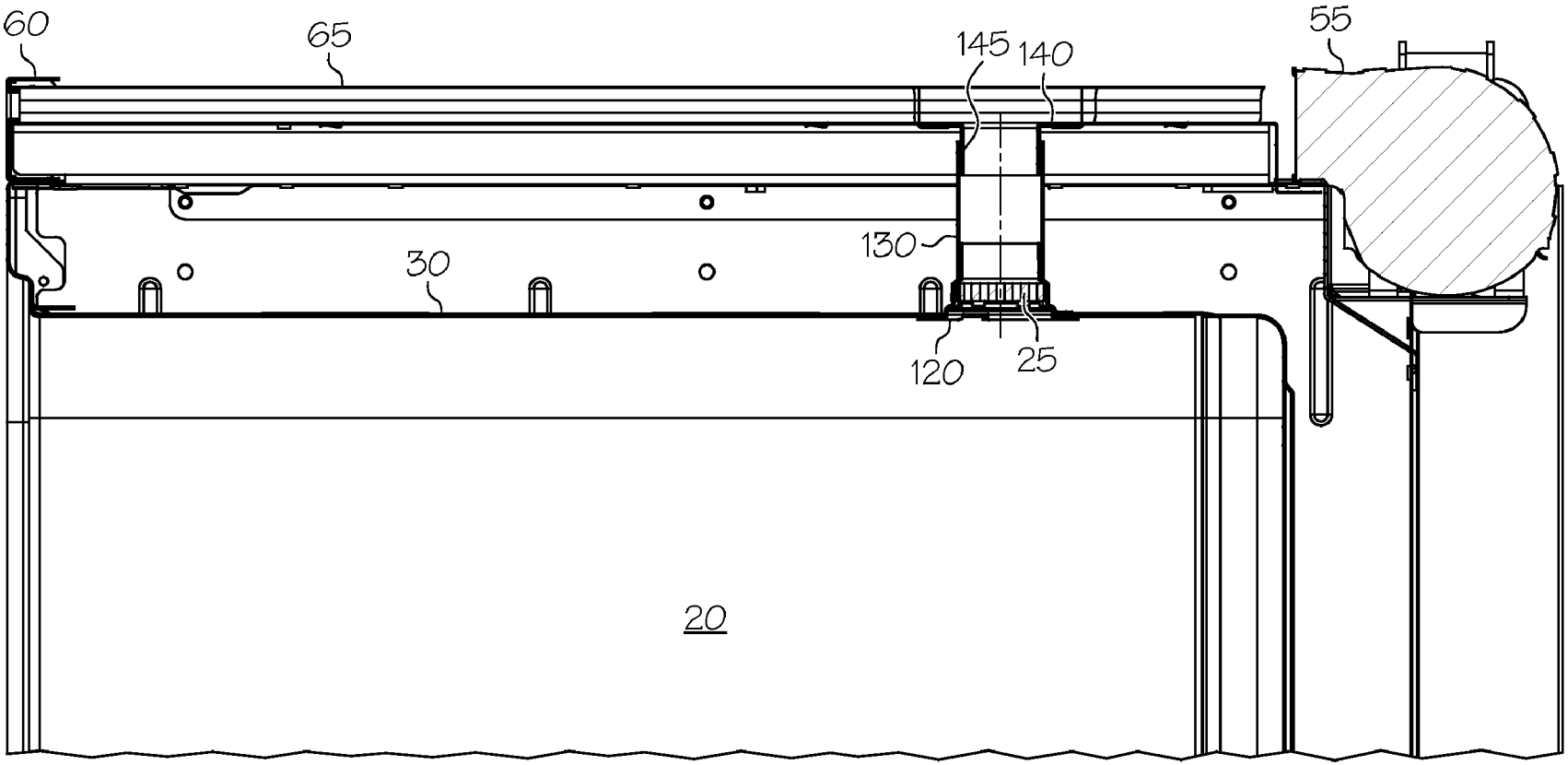
FIG. 7 illustrates a cross sectional view of the ventilation system of FIG. 5 in accordance with an aspect of the present invention.

FIGS. 5-7 illustrate another example ventilation system 110 that can be employed with a cooking appliance, such as an oven, in accordance with an aspect of the present invention. In FIGS. 5-7, those components that correspond to components shown in FIGS. 1-4 have the same reference numerals. The embodiment according to FIGS. 5-7 differs from the previously disclosed embodiment in that a cavity vent assembly 115 comprising a plurality of components is used. The cavity vent assembly 115 includes a catalyst support member 120 for holding a catalyst 125 (FIG. 7) therein. The catalyst 125 is provided for reduction of smoke and odors exhausted from the oven cavity 20. The catalyst support member 120 is coupled to a tube member 130. The cavity vent assembly 115 further comprises a coupling member 135, which has an annular flange portion 140 and a tube portion 145. The flange portion 140 of the coupling member 135 is configured to engage with a top surface of the plate member 65; and the tube portion 145 of the coupling member 135 is configured to engage with the tube member 130 of the cavity vent assembly 115. More specifically, a top surface of the plate member 65 includes an annular recess 150 formed in a top surface of the tunnel portion 70 in an area that corresponds with both the cavity vent assembly 115 and the venturi zone 100 positions. Accordingly, when the plate member 65 is coupled to the top wall 30 of the oven cavity 20, the tube member 130 is aligned with the aperture 75 in the tunnel portion 70, but does not extend into the aperture 75. The coupling member 135 is provided through the aperture 75 from a top surface of the tunnel portion 70 such that the annular flange 140 of the coupling member 135 is seated within the annular recess 150 of the tunnel portion 70. The tube portion 145 of the coupling member 135 is of a diameter such that the outer diameter of the tube portion 145 fits snugly within an inner diameter of the tube member 130. This snug connection mitigates leakage of exhaust gas from the oven cavity 20 as it travels through the cavity vent assembly 115.

The cavity vent assembly 115 of FIGS. 5-7 facilitates improved airflow through the chimney 50. The connection of the coupling member 135 and the tube member 130 ensures a fluid connection between the oven cavity 20 and the chimney 50. In other words, the coupling member 135 mitigates the occurrence of a cavity vent not fully extending into the chimney 50, thereby allowing exhaust gases to flow in between the top wall 30 of the oven cavity 20 and the plate member 65. The exhaust gases flow into the venturi zone 100 of the chimney 50 where the gases are then mixed with cooling air provided by the fan 55. Because the annular flange 140 of the coupling member 135 sits within the annular recess 150 of the plate member 65, there is nothing substantially extending into the chimney that would impede airflow from the cooling fan 55. Accordingly, the cooling fan air can better mix with the exhaust gases for improved smoke reduction and decreased humidity.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible.

The invention claimed is:

1. A cooking appliance having a ventilation system comprising:

a main cavity;

a cavity vent in fluid communication with the main cavity to expel an exhaust of gases; and a chimney connected above the cavity vent, wherein the chimney is defined by a top wall and opposing side walls, the opposing side walls being configured to form a venturi zone therein, wherein the cavity vent is coupled to the chimney at the venturi zone.

2. The cooking appliance of claim 1, further comprising a cooling fan that produces a cooling airflow into the chimney.

3. The cooking appliance of claim 2, wherein inside the chimney, the exhaust gases mixes with the cooling airflow from the cooling fan.

4. The cooking appliance of claim 1, wherein the venturi zone is formed by a narrowed neck portion in the chimney.

5. The cooking appliance of claim 1, wherein the chimney is a one-piece structure that extends from a front of a cooling fan to a front panel of the cooking appliance.

6. The cooking appliance of claim 1, wherein a cross sectional area of an entry section of the chimney is wider than a cross sectional area of the venturi zone, and wherein a cross sectional area of an exit section of the chimney is wider than the cross sectional area of the venturi zone.

7. The cooking appliance of claim 1, further comprising a catalyst positioned within the cavity vent.

8. The cooking appliance of claim 1, further comprising a plate member having a tunnel portion provided between a top wall of the main cavity and the chimney.

9. The cooking appliance of claim 8, wherein the tunnel portion includes an aperture through which the cavity vent extends.

10. The cooking appliance of claim 8, wherein the chimney is coupled to the tunnel portion via fasteners.

11. The cooking appliance of claim 1, further comprising a cooling fan and a front appliance panel, wherein an entry section of the chimney is adjacent the cooling fan and an exit section of the chimney is adjacent the front appliance panel.

12. The cooking appliance of claim 11, wherein the front appliance panel includes at least one vent for venting air flowing through the chimney.

13. A cooking appliance having a ventilation system comprising:

a main cavity;

a cavity vent assembly in fluid communication with the main cavity to expel an exhaust of gases from the main cavity; and a single passage connected above the cavity vent assembly includes a chimney having an entry section, a narrowed middle cross-section to create a venturi effect, and an exit section, wherein the cavity vent assembly is coupled to the chimney at the narrowed middle cross-section, and wherein the narrowed middle cross-section is formed by opposing side walls of the chimney.

14. The cooking appliance of claim 13, wherein the cavity vent assembly includes a tube member and a coupling member.

15. The cooking appliance of claim 14, wherein the cavity vent assembly includes a catalyst support member and a catalyst.

16. The cooking appliance of claim 14, further comprising a tunnel portion extending between the tube member and the coupling member wherein the chimney is coupled to a top of the tunnel portion and the cavity vent assembly does not extend into an airflow path in the chimney.

17. The cooking appliance of claim 13, further comprising a cooling fan provided near the entry section of the chimney.

* * * * *